US007476189B2

(12) United States Patent
Hale

(10) Patent No.: US 7,476,189 B2
(45) **Date of Patent: *Jan. 13, 2009**

(54) FOLDABLE EXERCISE MACHINE

(75) Inventor: Thomas J. Hale, Odessa, FL (US)

(73) Assignee: Halez LLC, Odessa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/855,346

(22) Filed: Sep. 14, 2007

(65) Prior Publication Data

US 2008/0058184 A1 Mar. 6, 2008

Related U.S. Application Data

(63) Continuation-in-part of application No. 11/532,673, filed on Sep. 18, 2006, now Pat. No. 7,311,644, which is a continuation-in-part of application No. 11/163,448, filed on Oct. 19, 2005, now Pat. No. 7,118,517.

(60) Provisional application No. 60/594,463, filed on Apr. 11, 2005.

(51) Int. Cl.
*A63B 26/00* (2006.01)

(52) U.S. Cl. ..... 482/142; 482/140

(58) Field of Classification Search ..... 482/140, 482/907, 91; 446/220

See application file for complete search history.

(56) References Cited

U.S. PATENT DOCUMENTS 4,126,326 A 11/1978 Phillips
5,690,389 A 11/1997 Ekman et al.
5,810,700 A 9/1998 Orcutt
5,833,587 A 11/1998 Strong et al.
6,152,865 A * 11/2000 Beauvoir ..... 482/140
6,309,331 B1 10/2001 Raymond
6,461,284 B1 10/2002 Francavilla
6,478,721 B1 11/2002 Hunter
6,669,611 B2 12/2003 Raymond
6,702,726 B2 3/2004 Lin
6,746,372 B2 6/2004 Hsu
6,913,318 B2 * 7/2005 Higley et al. ..... 297/383
7,118,517 B1 * 10/2006 Hale ..... 482/140
7,311,644 B2 * 12/2007 Hale ..... 482/142

* cited by examiner

*Primary Examiner*—Lori Amerson
(74) *Attorney, Agent, or Firm*—Ronald E. Smith; Smith & Hopen, P.A.

(57) ABSTRACT

An exercise device includes a deflatable spherical exercise ball mounted on a frame for rotation above a support surface that supports the frame so that the ball rotates freely without interference from the support surface. The frame is foldable so that when the ball is deflated, the frame may be stored in a space substantially smaller than the space occupied by the exercise device when in a fully deployed configuration. A first pair of inclined tubes is pivotally connected to one another at their respective upper ends so that they collectively form an inverted "V" shape when the device is fully deployed. A second pair of inclined tubes is transversely opposed to the first pair of inclined tubes. A forward base includes foot restraints. The first and second pairs of inclined tubes are coplanar with the forward base when the device is folded.

15 Claims, 3 Drawing Sheets

FOLDABLE EXERCISE MACHINE

CROSS-REFERENCE TO RELATED DISCLOSURES

This disclosure is a continuation-in-part of co-pending U.S. patent application Ser. No. 11/532,673, entitled: "Exercise Ball Mounted For Rotation," filed Sep. 18, 2006, by the present inventor, which application is a continuation-in-part of prior U.S. patent application Ser. No. 11/163,448, entitled: "Exercise Ball Mounted for Rotation," filed Oct. 19, 2005, which claims the benefit of U.S. provisional patent application 60/594,463, filed Apr. 11, 2005, now U.S. Pat. No. 7,118,517. All of said related disclosures are hereby incorporated by reference into this disclosure.

BACKGROUND OF THE INVENTION

1. Field of the Invention

This invention relates, generally, to exercise devices. More particularly, it relates to an exercise device having a large, deflatable, spherical exercise ball mounted for rotation to a frame. When the ball is deflated, the frame can be folded and stored in a low profile space such as under a bed.

2. Description of the Prior Art

U.S. Pat. No. 7,118,517 to the present inventor discloses an exercise device that includes a large spherical exercise ball mounted for rotation above a support surface such as a floor. The device performs its intended function, but it takes up sufficient space when not in use to prevent it from being stored in a low profile space such as under a bed.

A device like the known device but capable of being stored in a small area when not in use is desirable.

More particularly, it would be advantageous if the spherical ball of the known device could be deflated and if the frame to which the ball is mounted could be folded into a low profile.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved exercise device having a deflatable spherical ball mounted for rotation on a foldable frame is now met by a new, useful, and non-obvious invention.

The novel exercise device includes a spherical exercise ball and a frame. The ball is mounted on the frame for rotation at diametrically opposed poles of the ball, and the ball is mounted above a support surface that supports the frame so that the ball rotates freely without interference from the support surface. The ball is sufficiently large to enable an adult to sit upon it, lie across it in a supine, prone, or side posture, lean against it, and to contact it in various other ways in the course of performing physical exercises.

The ball is deflatable and the frame is foldable so that the ball, when in a deflated configuration, and frame, when in a folded configuration, may be stored when not in use in a space substantially smaller than the space occupied by the device when in a fully deployed configuration.

A first pair of inclined tubes includes a first forward inclined tube and a first rearward inclined tube positioned in a common vertical plane. The tubes are pivotally connected to one another at respective upper ends thereof so that they collectively form an inverted "V" shape when the exercise device is fully unfolded and deployed.

A second pair of inclined tubes includes a second forward inclined tube and a second rearward inclined tube positioned in a common vertical plane. The tubes are pivotally connected to one another at respective upper ends thereof so that they collectively form an inverted "V" shape when the device is fully unfolded and deployed. The second pair of inclined tubes is transversely opposed to the first pair of inclined tubes.

A first axle-engaging member is secured to a preselected tube of the first pair of inclined tubes in surmounting relation thereto and a second axle-engaging member is secured to a preselected tube of the second pair of inclined tubes in surmounting relation thereto.

First and second axle ends extend from the ball at diametrically opposed poles thereof, and the first and second axle-engaging members rotatably engage said first and second axle ends, respectively.

A first locking member is secured to a preselected tube of the first pair of inclined tubes in surmounting relation thereto. The first locking member is adapted to lock the first pair of inclined tubes into a predetermined angular relation with one another. A second locking member is secured to a preselected tube of the second pair of inclined tubes in surmounting relation thereto, and the second locking member is adapted to lock the second pair of inclined tubes into a predetermined angular relation with one another.

A quick release device unlocks the first and second locking members so that the first and second pairs of inclined tubes may be pivoted from their inverted "V" configuration and positioned in substantially parallel, closely spaced relation to one another to facilitate storage of the exercise device when the spherical ball is deflated.

A first and a second foldable brace are disposed in interconnecting relation between the first and second pairs of inclined tubes, respectively. The first and second foldable braces cooperate with the first and second locking members, respectively, to maintain the first and second pairs of inclined tubes in their inverted "V" configuration. The first and second braces are foldable to facilitate folding of the first and second pairs of inclined tubes into said parallel, closely spaced relation to one another.

The exercise device includes a horizontally-disposed, generally square forward base supported by a floor or other support surface and a horizontally-disposed rearward base of linear configuration supported by said floor or other support surface. The forward base includes a pair of transversely spaced apart, longitudinally disposed base tubes and a pair of transversely spaced apart, longitudinally disposed length adjustment tubes that are telescopically received within the longitudinally disposed base tubes, respectively. The forward base further includes a first transversely disposed tube, a first forward curved tube connected to a first end of the first transversely disposed tube and a second forward curved tube connected to a second end of the first transversely disposed tube. The first forward curved tube forms a gradual ninety degree bend and is disposed in interconnecting relation between a first end of the first transversely disposed tube and a first length adjustment tube of the pair of length adjustment tubes. The second forward curved tube also forms a gradual ninety degree bend and is disposed in interconnecting relation between a second end of the first transversely disposed tube and a second length adjustment tube of the pair of length adjustment tubes.

A first adjustment knob has a first spring-loaded pin secured thereto. A first aperture is formed in the first longitudinally disposed base member and a first plurality of apertures is formed in the first length adjustment tube. The first pin is adapted to extend through the first aperture and through a preselected aperture of said first plurality of apertures when the spring is in repose to lock the first length adjustment tube into a preselected position of adjustment relative to said first longitudinally disposed base member. The spring is loaded when the pin is retracted to enable adjustment of the telescoping members. The first adjustment knob and pin are removable to facilitate complete folding of the exercise device but the device may also be folded when the first adjustment knob and pin are not removed. A second adjustment knob has the same structure and performs the same job on the transversely opposed side of the device.

A feet-restraining device mounted to the first transverse tube includes first and second horizontal tubes for restraining the feet of a user. A first vertically disposed curved tube interconnects the first horizontally disposed tube to the first transversely disposed tube and a second vertically disposed curved tube interconnects the second horizontally disposed tube to the first transversely disposed tube. A horizontally disposed interconnecting tube has opposite ends secured to the first and second vertically disposed curved tubes in vertically spaced relation to the first transversely disposed tube.

The forward base further includes a second transversely disposed tube, a first rearward horizontally disposed curved tube connected to a first end of the second transversely disposed tube, and a second rearward horizontally disposed curved tube connected to a second end of the second transversely disposed tube. The first rearward curved tube forms a gradual ninety degree bend and is disposed in interconnecting relation between a first end of the second transversely disposed tube and a first base tube of the pair of base tubes. The second rearward curved tube forms a gradual ninety degree bend and is disposed in interconnecting relation between a second end of the second transversely disposed tube and a second base tube of the pair of base tubes.

A first clevis is mounted on the first longitudinally disposed base tube and a lower end of the first forward inclined tube is pivotally mounted to the first clevis. A second clevis is mounted on the second longitudinally disposed base tube and a lower end of the second forward inclined tube is pivotally mounted to the second clevis. The first and second forward inclined tubes are pivotal about the first and second clevises, respectively, so that the first and second forward inclined tubes are substantially coplanar with the first and second longitudinally disposed base tubes of the forward base when the spherical ball is deflated and the exercise device is in its folded configuration.

The rearward base includes a third transversely disposed tube, a first inclined rearward curved tube connected to a first end of the third transversely disposed tube, and a second inclined rearward curved tube connected to a second end of the third transversely disposed tube. The first rearward curved tube forms a gradual ninety degree bend and is disposed in interconnecting relation between a first end of the third transversely disposed tube and a lower end of the first rearward inclined tube. The second rearward curved tube forms a gradual ninety degree bend and is disposed in interconnecting relation between a second end of the third transversely disposed tube and a lower end of the second rearward inclined tube.

A first curved handle formed in a gradual ninety degree bend is releasably secured to an upper end of the first rearwardly inclined tube and a second curved handle formed in a gradual ninety degree bend is releasably secured to an upper end of the second rearwardly inclined tube. More particularly, each handle has a curved padded part adapted to be gripped by a user, and a truncate unpadded part that is apertured and telescopically received within the lumen of its associated rearwardly inclined tube which is also apertured. A spring-loaded pin extends through the apertures when said apertures are aligned with one another to lock the handles onto their respective rearwardly inclined tubes. Each pin is mounted on an associated adjustment knob so that a user may compress and release the spring as desired.

A first brace having a square "C" shape releasably interconnects a lower end of the first forwardly inclined tube and the first horizontally disposed rearward curved tube and a second brace of the same shape releasably interconnects a lower end of the second forwardly inclined tube and the second horizontally disposed rearward curved tube. The first and second braces prevent folding of the forward base relative to the first and second forward inclined tubes. Removal of the first and second braces enables folding of the forward base relative to the first and second forward inclined tubes.

The primary object of the invention is to provide an exercise device having a frame that is quickly and easily folded into a storage configuration when not in use and which is just as easily unfolded and deployed for use.

A closely related object is to provide an exercise device having a large spherical ball mounted for rotation thereon and which is deflatable for storage purposes.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
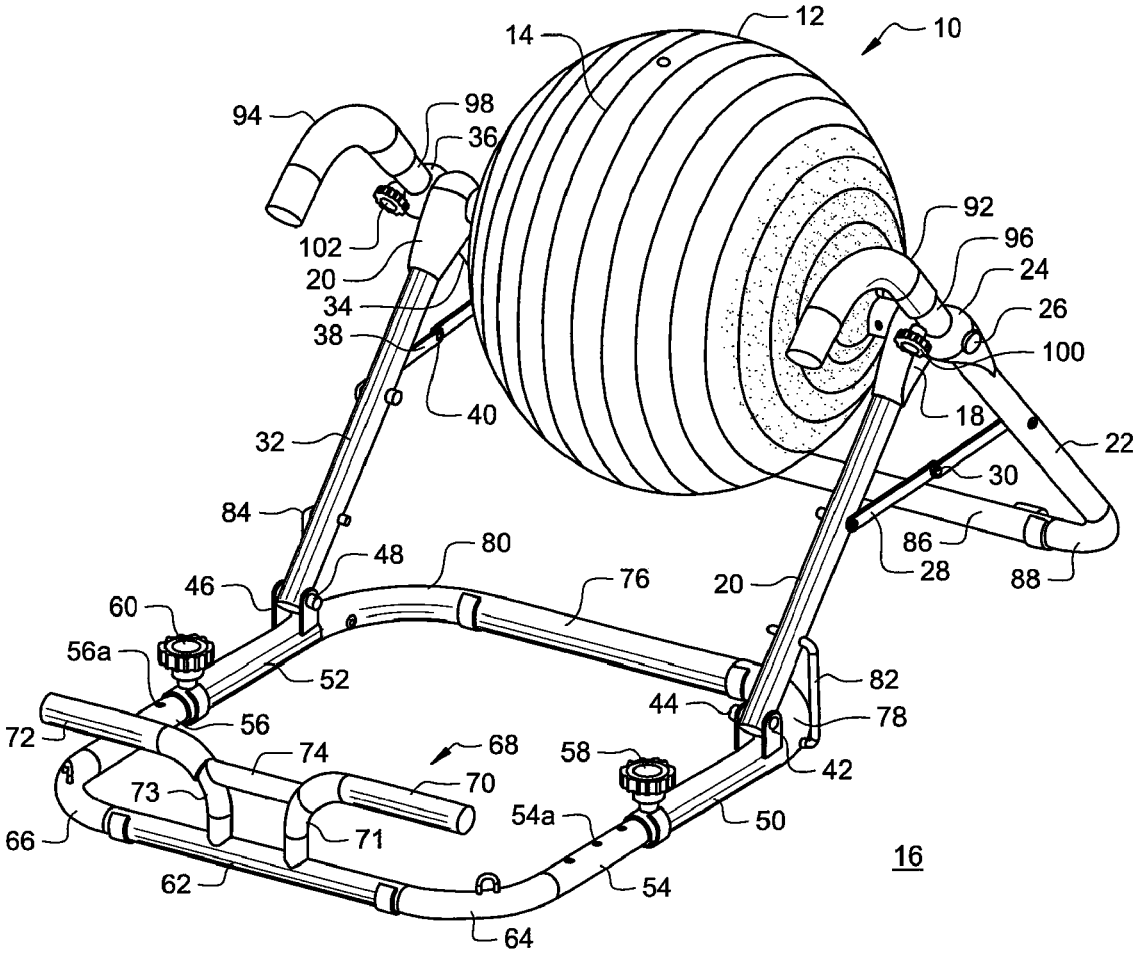
FIG. 1 is a perspective view of the novel structure when operably configured.

Referring now to FIG. 1, it will there be seen that an illustrative embodiment of the invention is denoted as a whole by the reference numeral 10.

Large spherical exercise ball 12 has latitude lines 14 drawn thereon to simplify the description of the mounting means therefore. Specifically, if lines 14 are thought of as latitude lines, then it may be said that ball 12 is mounted for rotation at its opposite poles, each of which is diametrically opposed to the other pole.

There are several ways of rotatably mounting ball 12 and each of said ways are within the scope of this invention because the main feature of the ball is that it is mounted above support surface or floor 16 so that it rotates freely without interference from said floor 16. For example, an elongate axle may extend through the hollow ball from pole to pole, said axle having a length greater than the diameter of the ball so that its opposite ends protrude from the ball and are engaged by the frame of the device that supports the ball in spaced relation from the floor. In the alternative, two (2) truncate axles may be used, with one truncate axle positioned at each pole and with each truncate axle being engaged by the frame of device 10.

Without regard to the type of axle used, axle-engaging members 18, 20 which form a part of the frame are positioned in alignment with each pole of the ball and are adapted to rotatably engage their respective axles.

Axle-engaging member 18 is supported by forward and rearward inclined tubes 20 and 22 that collectively form an inverted "V" shape when device 10 is deployed in its operable configuration as depicted. Locking device 24 surmounts rearward inclined tube 22 and pivotally engages axle-engaging member 18. More particularly, when device 10 is in its fully deployed configuration as depicted in FIG. 1, locking device 24 locks with axle-engaging member 18 so that said device 24 and member 18 are held in a fixed angular relation. Pressing on button 26 unlocks the locking mechanism so that the respective lower ends of inclined tubes 20, 22 may be brought close to one another. There are numerous locking mechanisms for holding two items in a fixed angular relation to one another until a button is pushed, and any of such mechanisms may be employed with this invention.

Foldable brace 28, which folds mid-length thereof at pivot point 30, takes some of the strain from the locking mechanism in device 24 in that its opposite ends are secured to inclined tubes 20, 22 about mid-length of said tubes, thereby holding them in the depicted angular disposition. Since the locking mechanism in device 24 and said brace 28 both maintain inclined tubes 20, 22 in their operable positions, it is understood that brace 28 could be eliminated if the locking mechanism is strengthened. Conversely, the locking mechanism in device 24 could be eliminated if brace 28 is made sufficiently strong to hold inclined tubes 20, 22 in their operable positions.

The same structure is repeated on the opposite side of ball 12. The inclined forward and rearward inclined tubes on said opposite side are denoted 32, 34 and the locking device at the upper end of rearward inclined tube 34 is denoted 36. The push button associated with device 36 is not visible in this perspective view. Foldable brace 38 has pivot point 40 at its midpoint and it performs the same function as its counterpart brace 28.

The lower ends of first and second forward inclined tubes 20, 32 are pivotally connected to a forward base of generally square configuration and the lower ends of first and second rearward inclined tubes 22, 34 are connected to a rearward base of linear configuration.

More particularly, the lower end of first forward inclined tube 20 is captured in clevis 42 by clevis pin 44 so that said lower end is rotatable about said pin 44. The lower end of second forward inclined tube 32 is captured in clevis 46 having pin 48 for the same reason.

Clevis 42 and clevis 46 are respectively mounted on longitudinally disposed base tubes 50, 52 that form a part of the forward base. Base tubes 50, 52 telescopically receive length adjustment tubes 54, 56, each of which has apertures, collectively denoted 54*a* and 56*a*, respectively, that are equidistantly and longitudinally spaced along the respective lengths of said adjustment tubes. Adjustment knobs 58 and 60 are secured to spring-loaded pins that respectively lock and unlock tubes 50, 54 and 52, 56 into and from their respective positions of telescopic adjustment in a well-known way.

First transversely disposed tube 62 forms a part of the forward base and is joined at its opposite ends to said length adjustment tubes 54, 56 by first and second horizontal curved tubes 64, 66, each of which forms a gradual ninety degree (90°) bend.

Feet-restraining device 68 is mounted to first transverse tube 62. A user places his or her feet atop first transverse tube 62 and below horizontal tubes 70, 72 when performing selected exercises. Tube 74 unites restraint tubes 70, 72 and therefore helps prevent them from bending upwardly if subjected to strong upwardly-directed forces. First and second vertically disposed curved tubes 71, 73 interconnect said horizontal tubes 70, 72 to first transversely disposed tube 62, respectively.

Second transversely disposed tube 76, also a part of the forward base, is joined at its opposite ends to base tubes 50, 52 by rearward horizontally disposed curved tubes 78, 80, each of which forms a gradual ninety degree (90°) bend.

Square "C"-shaped braces 82, 84 help support first and second forward inclined tubes 20, 32 by interlocking said tubes with said rearward horizontally disposed curved tubes 78, 80, respectively.

The rearward base includes third transversely disposed tube 86, at the trailing end of device 10. Tube 86 is joined at its opposite ends to rearward inclined tubes 22, 34 by first and second inclined curved tubes 88, 90, each of which forms a gradual ninety degree (90°) bend.

Handles 92, 94 form a gradual ninety degree bend and are padded as depicted to facilitate gripping by a user. An unpadded truncate part of said handles has an aperture formed therein and is slidingly received within the lumen of rearward inclined tubes 22, 34 at the respective upper ends thereof, which upper ends are denoted 96, 98 and which are also apertured. Locking knobs 100, 102 are secured to spring loaded pins that are in repose to extend through aligned apertures to lock handles 92, 94 to said upper ends and that are loaded when the pins are retracted to enable removal of said handles from said upper ends.

Device 10 is folded into a storage configuration by deflating ball 12 by any suitable well-known means, pressing on button 26 and its unillustrated counterpart, pushing braces 28, 38 either up or down at their respective pivot points 30, 40, folding forward inclined tubes 20, 32 toward rearward inclined tubes 22, 34, respectively, and rotating forward inclined tubes 20, 32 toward first transverse tube 62 to cause said forward inclined tubes to rotate about their respective clevis pins. The folded device may then be slid under a bed or placed in some other suitable storage location.

Figure 2:
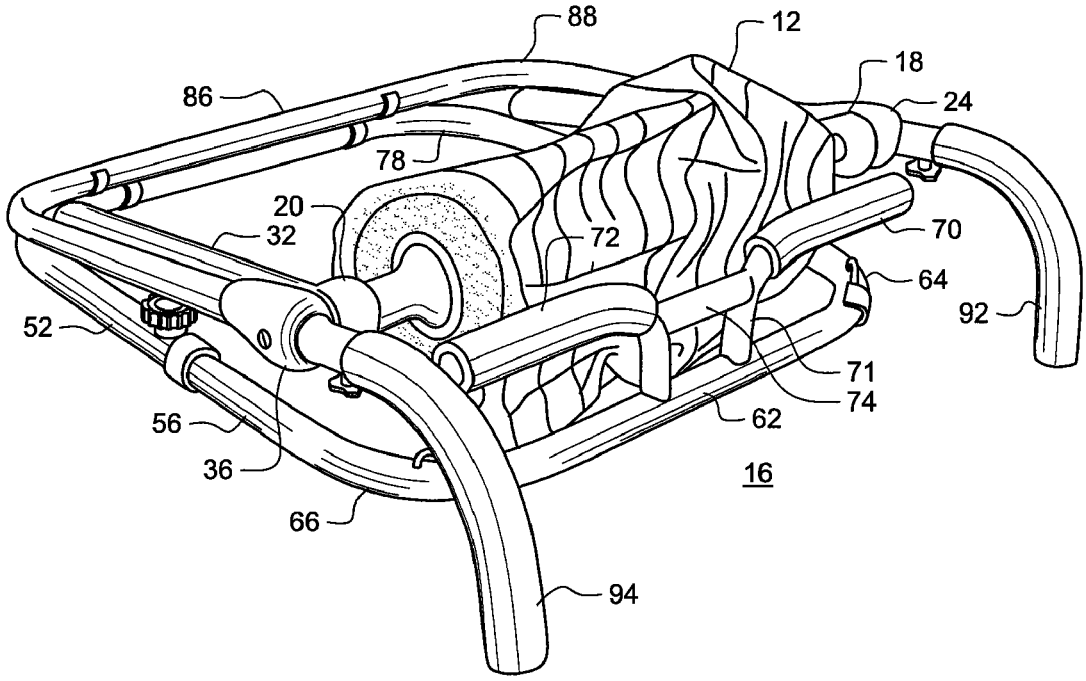
FIG. 2 is a perspective view of the machine in its folded configuration with handles and adjustment knobs not removed.
Figure 3:
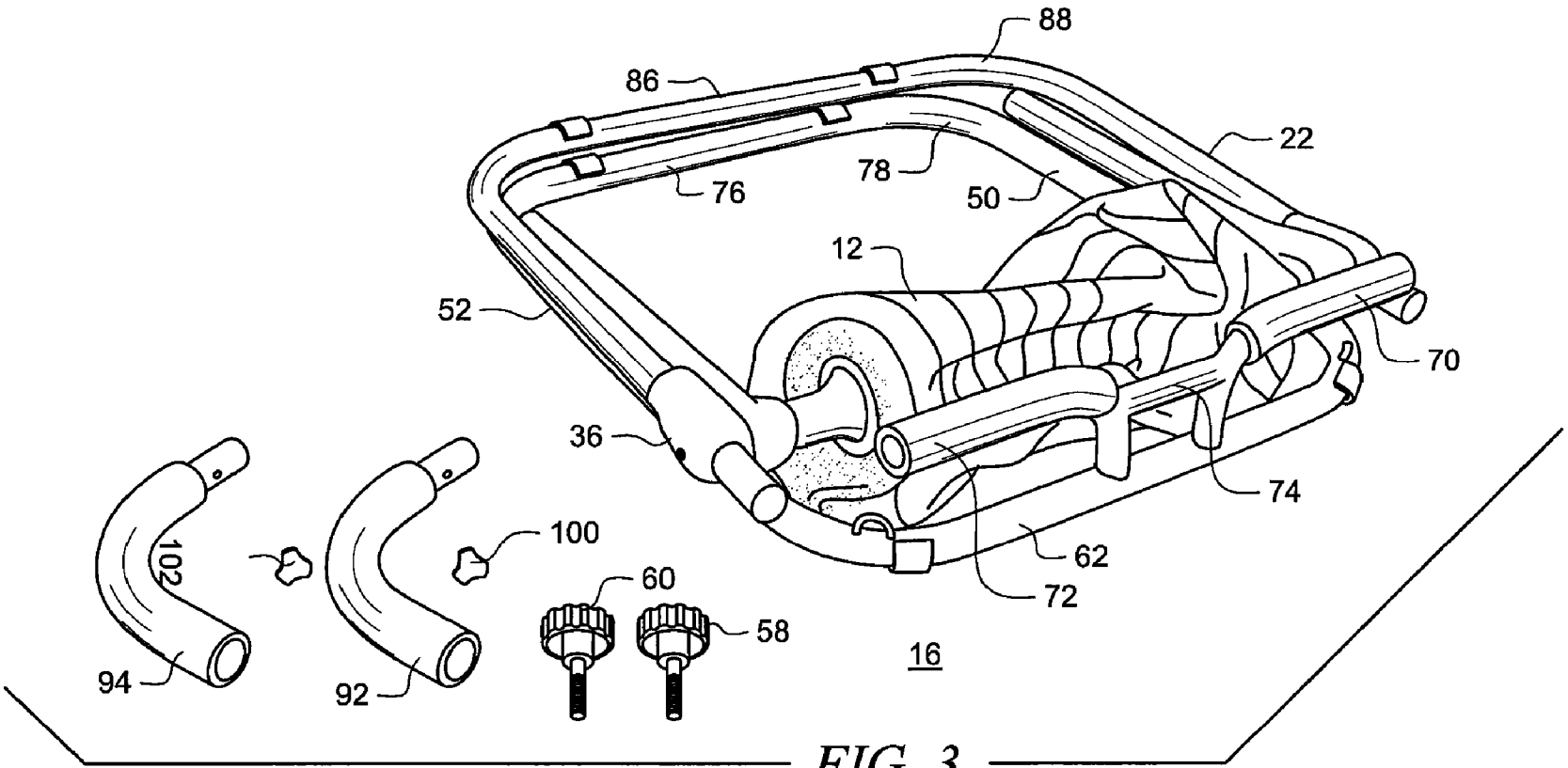
FIG. 3 is a perspective view of the machine in its folded configuration with handles and adjustment knobs removed.

FIG. 2 depicts the device when folded with handles 92, 94 in their connected configuration. FIG. 3 depicts the device when folded with handles 92, 94 removed. Locking knobs 100, 102 must be removed to enable removal of handles 92, 94. Length adjustment knobs 58, 60 are removed to enable tubes 20, 32 to lie down flat without obstruction from said knobs 58, 60.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An exercise device, comprising:

a spherical exercise ball;

a frame;

said ball being mounted on said frame for rotation at diametrically opposed poles of said ball;

said ball being mounted above a support surface adapted to support said frame so that said ball rotates freely without interference from said support surface;

said ball being deflatable and said frame being foldable so that said ball and frame, when deflated and folded, respectively, may be stored when not in use in a space substantially smaller than the space occupied by said exercise device when in a fully deployed configuration.

2. The exercise device of claim 1, further comprising:

a first pair of vertically disposed inclined tubes pivotally connected to one another at respective upper ends thereof so that they collectively form an inverted "V" shape when said device is deployed in said fully deployed configuration;

said first pair of inclined rigid tubes including a first forward inclined tube and a first rearward inclined tube;

a second pair of vertically disposed inclined tubes pivotally connected to one another at respective upper ends thereof so that they collectively form an inverted "V" shape when said device is deployed in said fully deployed configuration, said second pair of inclined tubes being transversely opposed to said first pair of inclined rigid tubes;

said second pair of inclined tubes including a second forward inclined tube and a second rearward inclined tube;

a first axle-engaging member secured to a preselected tube of said first pair of inclined tubes in surmounting relation thereto;

a second axle-engaging member secured to a preselected tube of said second pair of inclined tubes in surmounting relation thereto;

first and second axle ends extending from said ball at diametrically opposed poles of said ball;

said first and second axle-engaging members rotatably engaging said first and second axle ends, respectively.

3. The exercise device of claim 2, further comprising:

a first locking member secured to a preselected tube of said first pair of inclined tubes in surmounting relation thereto;

said first locking member adapted to lock said first pair of inclined tubes into a predetermined angular relation with one another;

a second locking member secured to a preselected tube of said second pair of inclined tubes in surmounting relation thereto; and said second locking member adapted to lock said second pair of inclined tubes into a predetermined angular relation with one another.

4. The exercise device of claim 3, further comprising:

a quick release device for unlocking said first and second locking members so that said first and second pairs of inclined tubes may be pivoted from said inverted "V" configuration and positioned in substantially parallel, closely spaced relation to one another to facilitate storage of the exercise device when the ball is deflated.

5. The exercise device of claim 3, further comprising:

a first and a second foldable brace disposed in interconnecting relation between the first and second pairs of inclined tubes, respectively;

said first and second foldable braces cooperating with said first and second locking members, respectively, to maintain said first and second pairs of inclined tubes in said inverted "V" configuration;

said first and second braces being foldable to facilitate said folding of said first and second pairs of inclined tubes into said parallel, closely spaced relation to one another.

6. The exercise device of claim 2, further comprising:

said exercise device including a forward base and a rearward base;

said forward base including a pair of transversely spaced apart, longitudinally disposed base tubes;

said forward base further including a pair of transversely spaced apart, longitudinally disposed length adjustment tubes that are telescopically received within said longitudinally disposed base tubes, respectively;

a first transversely disposed tube;

a first forward curved tube connected to a first end of said first transversely disposed tube;

a second forward curved tube connected to a second end of said first transversely disposed tube;

said first forward curved tube forming a gradual ninety degree bend and disposed in interconnecting relation between a first end of said first transversely disposed tube and a first length adjustment tube of said pair of length adjustment tubes;

said second forward curved tube forming a gradual ninety degree bend and disposed in interconnecting relation between a second end of said first transversely disposed tube and a second length adjustment tube of said pair of length adjustment tubes.

7. The exercise device of claim 6, further comprising:

a first adjustment knob;

a first pin secured to said first adjustment knob;

a first aperture formed in said first longitudinally disposed base tube;

a first plurality of apertures formed in said first length adjustment tube;

said first pin adapted to extend through said first aperture and through a preselected aperture of said first plurality of apertures to lock said first length adjustment tube into a preselected position of adjustment relative to said first longitudinally disposed base tube;

said first adjustment knob and pin being removable to facilitate folding of said exercise device.

8. The exercise device of claim 7, further comprising:

a second adjustment knob;

a second pin secured to said second adjustment knob;

a second aperture formed in said second longitudinally disposed base tube;

a second plurality of apertures formed in said second length adjustment tube;

said second pin adapted to extend through said second aperture and through a preselected aperture of said second plurality of apertures to lock said second length adjustment tube into a preselected position of adjustment relative to said second longitudinally disposed base tube;

said second adjustment knob and pin being removable to facilitate folding of said exercise device.

9. The exercise device of claim 6, further comprising:

a feet-restraining device for restraining the feet of a user of said exercise device;

said feet-restraining device mounted to said first transverse tube;

said feet-restraining device including first and second horizontal tubes;

a first vertically disposed curved tube that interconnects said first horizontally disposed tube to said first transversely disposed tube; and a second vertically disposed curved tube that interconnects said second horizontally disposed tube to said first transversely disposed tube.

10. The exercise device of claim 9, further comprising:

a horizontally disposed interconnecting tube having opposite ends secured to said first and second vertically disposed curved tubes in vertically spaced relation to said first transversely disposed tube.

11. The exercise device of claim 6, further comprising:

a second transversely disposed tube;

a first rearward horizontally disposed curved tube connected to a first end of said second transversely disposed tube;

a second rearward horizontally disposed curved tube connected to a second end of said second transversely disposed tube;

said first rearward curved tube forming a gradual ninety degree bend and disposed in interconnecting relation between a first end of said second transversely disposed tube and a first base tube of said pair of base tubes;

said second rearward curved tube forming a gradual ninety degree bend and disposed in interconnecting relation between a second end of said second transversely disposed tube and a second base tube of said pair of base tubes.

12. The exercise device of claim 11, further comprising:

a first clevis mounted on said first base tube;

a lower end of said first forward inclined tube being pivotally mounted to said first clevis;

a second clevis mounted on said second base tube;

a lower end of said second forward inclined tube being pivotally mounted to said second clevis;

whereby said first and second forward inclined tubes are pivotal about said first and second clevises, respectively, so that said first and second forward inclined tubes are substantially coplanar with said first and second base tubes of said forward base when said ball is deflated and said exercise device is in its folded configuration.

13. The exercise device of claim 12, further comprising:

said rearward base including a third transversely disposed tube;

a first rearward curved tube connected to a first end of said third transversely disposed tube;

a second rearward curved tube connected to a second end of said third transversely disposed tube;

said first rearward curved tube forming a gradual ninety degree bend and disposed in interconnecting relation between a first end of said third transversely disposed tube and a lower end of said first rearward inclined tube;

said second rearward curved tube forming a gradual ninety degree bend and disposed in interconnecting relation between a second end of said third transversely disposed tube and a lower end of said second rearward inclined tube.

14. The exercise device of claim 13, further comprising:

a first curved handle releasably secured to an upper end of said first rearward inclined tube;

said first curved handle formed in a gradual ninety degree bend;

a second curved handle releasably secured to an upper end of said second rearward inclined tube; and said second curved handle formed in a gradual ninety degree bend.

15. The exercise device of claim 14, further comprising:

a first brace for releasably interconnecting a lower end of said first forwardly inclined tube and said first horizontally disposed rearward curved tube; and a second brace for releasably interconnecting a lower end of said second forwardly inclined tube and said second horizontally disposed rearward curved tube;

whereby folding of said forward base relative to said first and second forward inclined tubes is prevented by said first and second braces; and whereby folding of said forward base relative to said first and second forward inclined tubes is enabled by removal of said first and second braces.

* * * * *